252-103 AU 166 EX
1/5/82 XR 4,309,299

United States Patent [19]
Rapisarda et al.
[11] 4,309,299
[45] Jan. 5, 1982

[54] DETERGENT COMPOSITION HAVING IMPROVED CHLORINE RETENTION CHARACTERISTIC AND METHOD OF MAKING SAME

[75] Inventors: Anthony A. Rapisarda, Elmhurst, N.Y.; Joseph Romeo, Bergenfield, N.J.

[73] Assignee: Lever Brothers Company, New York, N.Y.

[21] Appl. No.: 184,576

[22] Filed: Sep. 4, 1980

[51] Int. Cl.[3] ..... C11D 7/54
[52] U.S. Cl. ..... 252/95; 252/99; 252/103; 252/187 H; 424/14; 424/149
[58] Field of Search ..... 252/95, 99, 103, 187 H; 424/14, 149

[56] References Cited

U.S. PATENT DOCUMENTS 3,491,028 1/1970 Crotty et al. ..... 252/95 X
3,519,569 7/1970 Diaz ..... 252/103 X
3,692,685 9/1972 Lamberti et al. ..... 252/132 X
4,078,099 3/1978 Mazzola ..... 252/100
4,126,717 11/1978 Mazzola ..... 427/425 X
4,127,496 11/1978 Stokes ..... 252/103 X
4,199,468 4/1980 Barford et al. ..... 252/103
4,242,216 12/1980 Daugherty et al. ..... 252/103

*Primary Examiner*—Mayer Weinblatt
*Attorney, Agent, or Firm*—Mishrilal L. Jain; James J. Farrell; Melvin H. Kurtz

[57] ABSTRACT

The premature release of chlorine from chlorine-releasing bleaching agents in a particulate detergent, caused by the action on such a bleaching agent by some other component in the detergent, is prevented by compacting and granulating a mixture of said other component, preferably with additional constituents which do not have the chlorine-releasing effect, and then mixing those granules with the chlorine-releasing bleaching agent and other appropriate detergent constituents. The resulting novel detergent is a mixture of the thus-produced granules with particles of the said other appropriate detergent constituents.

27 Claims, No Drawings

DETERGENT COMPOSITION HAVING IMPROVED CHLORINE RETENTION CHARACTERISTIC AND METHOD OF MAKING SAME

The present invention relates to a method of improving chlorine retention in detergents containing chlorine-releasing bleaching agents, and to the novel detergent mixture resulting therefrom.

Many detergents contain, along with the standard constituents (detergent compound, builder, and other constituents such as filler, deposition inhibitor, corrosion inhibitor, perfume and the like), chlorine-releasing agents which have the property of releasing chlorine in the presence of water. These bleaching agents are desirable because, by combining with protein soils, they fight spot formation, they remove stains, and they have a germicidal effect. The amount of available chlorine desired in detergents may vary widely, depending upon the intended use of the detergent, but in the context of a machine dishwasher the available chlorine generally amounts to 0.2% or greater, and preferably in the range of 0.5–1%.

There is a great demand for detergents in solid, particulate, free-flowing condition. Such particulate detergents typically are packed in cartons, and may be required to stand for relatively long periods of time before being used, either while in storage in warehouses and on the shelves of stores or in pantries of homes or, indeed, after the cartons have been opened and the contents thereof only partially used. It is important, therefore, that chlorine not be released from the bleaching agent prematurely, during that storage period, so that the chlorine can be released to perform its desired bleaching function in appropriate amount when the detergent is used, to wit, when it is mixed with water in the washing machine or basin.

It frequently occurs that some of the constituents of the overall detergent composition will, if the bleaching composition is exposed to them or brought into contact with them, cause the bleaching agent to release some or all of its chlorine. This problem has become more important in recent years because of the advent of non-P or low P-containing detergent products. In such cases non-P chlorine releasing agents and non-P builders are utilized. The non-P chlorine releasing agents are considerably more prone to lose chlorine than the heretofore utilized chlorinated trisodium phosphate which is relatively stable. Also, the non-P builders, particularly the organic type, are available in hydrate form, the water content of which may adversely affect the stability of the chlorine releasing agent. Further, some of the components such as the organic builder or the surfactant may contain oxidizable or chlorine reactive functional groups and may thereby react directly with the chlorine releasing agent causing a premature loss of chlorine during manufacture.

Materials suitable for use as a substitute for phosphorus-containing bleaching agents are well known. Many of them are disclosed in Mazzola U.S. Pat. Nos. 4,078,099 and 4,126,717, the disclosures of which are here incorporated by reference, particularly column 7, line 62—column 8, line 51 of U.S. Pat. No. 4,078,099. These non-phosphorus-containing chlorine-releasing bleaching agents act to release chlorine upon contact with water. It is this characteristic which, prior to the present invention, to a greater or lesser degree, militated against their use in detergent compositions in which water is present as a part of other constituents of the overall detergent composition.

A preferred example of the non-phosphorus-containing chlorine-releasing bleaching agent is sodium dichloroisocyanurate dihydrate. This material has good stability even though it is in a hydrate form. However, the presence of additional water in the detergent composition either as free water or as loosely bound hydrates of other components of the detergent composition can lead to a hydrolytic breakdown of the chlorinated isocyanurate and a subsequent loss of chlorine. The presence of additional free or loosely bound water in the formulation must ordinarily be carefully avoided when using this type of chlorine-releasing agent. The present invention, however, provides a simple way of utilizing this preferred type of chlorine-releasing agent even in the presence of such additional water in the formulation. The invention thus provides greater flexibility and economy to the formulator in designing his detergent composition by allowing the use of additional components which may be economically available only in hydrate form.

One group of materials commonly used as a substitute for phosphorus-containing builders are the normal alkali metal, ammonium and lower mono-, di- and trialkanolamine salts of ether polycarboxylic acids described and claimed in Lamberti et al U.S. Pat. No. 3,692,685 of Sept. 19, 1972, entitled "Detergent Compositions", and assigned to the assignee of this application, the disclosure of which patent is here incorporated by reference. One of the most promising of the non-phosphorus-containing builders to which that patent relates is carboxymethyloxysuccinate, generally referred to in the industry as CMOS.

CMOS and the other members of the builder family to which it belongs are, when stable, generally present in the form of a hydrate. If CMOS particles in that hydrate form come close to or are exposed to moisture-sensitive chlorine-releasing bleaching agents, the hydrated moisture of the CMOS will adversely affect the chlorine-retention characteristics of the bleaching agent and produce a slow but steady release of chlorine which will adversely reduce the effective shelf life of the detergent product. The present invention, however, enables one to utilize the highly desirable non-P detergent builder, CMOS, without incurring such adverse losses of chlorine.

A particulate detergent mixture must have other characteristics besides functioning as a cleaning composition and retaining the chlorine until it is wanted. It must be free-flowing, and the particulate substances of which it is made up must be of such a character that when once mixed together they will remain homogeneously mixed, and will not segregate out or settle, so that when the housewife pours the detergent from the box all of the components thereof, in proper relative proportions, will emerge from the box. Also, the bulk density of a detergent composition such as one for machine dishwashing must be relatively high, for example, higher than about 0.7 grams per cc., so that it will deliver the proper dosage. The present invention readily enables one to control the bulk density of such formulation as will be described hereinafter.

It has been observed that the use of organic builders such as CMOS replacing in whole or in part the formerly popular phosphorus-containing builders in detergent compositions containing chlorine-releasing bleaching agents had a deleterious effect on the detergent action of the composition, particularly in connection with spotting and filming when the detergent was used for dishwashing purposes. This is explicitly brought out in Barford, et al U.S. Pat. No. 4,199,468 of Apr. 22, 1980 entitled "Alkaline Dishwasher Detergent". As a result, use of such non-phosphorus-containing builders in detergent compositions has met with considerable resistance both on the part of consumers, who feel that the new phosphorus-free detergents do not do a good enough job, and on the part of the technicians involved, who find that the consumer dissatisfaction has much merit and who have not been able to devise satisfactory ways of solving the problems presented.

The deleterious effect on chlorine-releasing bleaching agents of detergent components (hereinafter termed "premature release components"), such as CMOS and related compounds, is well known. One attempt to eliminate or minimize the problem involved has been to encapsulate the individual particles of the bleaching agent by coating them with some plastic material which will readily dissolve when the detergent is placed in water, thereby to expose the particles of bleaching agent to the chlorine-releasing action of the water. See Mazzola U.S. Pat. Nos. 4,126,717 of Nov. 21, 1978 and 4,078,099 of Mar. 7, 1978, both entitled "Encapsulated Bleaches and Methods for Their Preparation", and both owned by the assignee of this application. That approach is theoretically effective, but has drawbacks where low cost dry mixed detergents are involved. The encapsulating material, and the process steps involved, constitute additional elements of cost. Also, the encapsulation process for chlorine-containing sources will often introduce into the mix materials which, particularly where dishwashing detergents are involved, are considered to be soils, thus severely taxing the abilities of the detergent.

In accordance with the instant invention, the deleterious effects on chlorine-releasing bleaching agents of premature release components of the detergent composition is virtually eliminated without having to use any additional constituents and in a way which does not detract from, but in fact improves, the homogeneity and pourability of the detergent composition.

This result is achieved by taking the premature release component (or components) and forming appropriately sized granules of that component, preferably together with others of the detergent constituents (not including the bleaching agent) which do not have that adverse affect on the bleaching agent, and then mixing those granules with the bleaching agent and such other detergent constituents as may be desired. These granules are conveniently produced by compacting the selected constituent or constituents under relatively high pressure to form a compacted mass, and then breaking up the compacted mass into granules of appropriate size. When this is done, the bleaching agent retains its chlorine to a very significantly greater degree than when the compaction and granulation process is not carried out. The reason for this result is not known for certain. It is believed that there is a reduction in the overall exposed surface area of the premature release component, and that when the granule also includes other non-chlorine-releasing agents each granule comprises a large number of particles of the premature release component in a matrix of the other constituents, so that at most only a relatively few of the premature release component particles are exposed on the surface of the granule, the vast majority of such particles being protectively hidden inside the granule. Hence only a very small proportion of the premature release component content can adversely affect the bleaching agent.

As indicated, the formation of these granules is easily accomplished on a production scale, and may be carried out by existing production machinery. What is involved is, in the preferred embodiment, forming a mixture of the premature release component and the other constituents, compacting that mixture, as by passing it between a pair of compaction rolls, and then breaking up the compacted mass into granules of desired size. One machine eminently capable of carrying out this procedure is that offered for sale by the Fitzpatrick Company of Elmhurst, Ill. under the trade name "Chilsonator". The Chilsonator compresses powders into densified sheets by passing them between compaction rolls, the sheets are then broken up and then screened to desired particle size, the granules of desired size are removed from the machine, and the granules which are oversize and undersize are fed back into the machine for reprocessing along with the powders.

The compaction and granulation procedure here disclosed is valuable in connection with the formulation of particulate detergents of any type which contain chlorine-releasing bleaching agents, and its practice is not limited to any particular chemical composition for the bleaching agent, the chlorine-releasing component or any of the other detergent constituents, but is instead of general application and use in accordance with the preceding exposition.

In the present state of the detergent art, however, it is thought that the present invention will have its most immediate impact in the case of non-phosphate machine dishwasher detergents, since those detergents contain chlorine-releasing bleaching agents and organic builders, such as CMOS, citrates, nitrilotriacetates and the like, as well as active detergent compositions which, when brought into contact with the bleaching agent, will tend to cause premature chlorine release therefrom. The invention will therefore be described in detail in connection with such a detergent.

A non-phosphate machine dishwasher detergent, like other detergents, includes a water-soluble organic detergent compound, a builder, and one or more other constituents serving the functions of filler, deposition inhibitor, corrosion inhibitor, perfume, soil suspending agents, hydrotopes, dyes, enzymes, suds depressants, germicides, antitarnishing agents, cationic detergents, water softeners, buffers and the like, in addition to the previously mentioned chlorine-releasing agent.

The surfactants or detergent compounds that are useful in the present invention are the anionic (soap and nonsoap), nonionic, zwitterionic and ampholytic compounds. The chemical nature of these detergent compounds is not an essential feature of the present invention. Moreover, such detergent compounds are well known to those skilled in the detergent art and the patent and printed literature are replete with disclosures of such compounds. Typical of such literature are "Surface Active Agents" by Schwartz and Perry and "Surface Active Agents and Detergents" by Schwartz, Perry and Berch, the disclosures of which are incorporated by reference herein.

The active detergents, which are often provided in liquid form and sprayed onto the builder granules, may contain reactive functional groups as well as traces of moisture and residual catalysts used in their manufacture. The interaction of these active detergents with the chlorine-releasing bleaching agents tends to cause premature release of the chlorine content of the latter. It may be noted at this point that the result of such spraying, particularly where increased levels of detergent are involved, produce coatings on the builder granules which tend to cause tackiness, lumping, caking and poor flow. That problem is particularly present in non-phosphorus-containing detergent compositions, where increased levels of active detergent are usually required. It may be noted at this point that the compaction and granulation procedure here disclosed permits the use of such higher levels of active detergent without experiencing the above mentioned deleterious effects of tackiness, lumping, caking and poor flow. The reason for this unexpected advantage of the procedure here disclosed is not known.

Phosphorus-free builders for such a detergent composition are the normal alkali metal, ammonium and lower mono-, di- and trialkanolamine salts of ether polycarboxylic acids selected from the group consisting of oxydisuccinic acid and carboxymethyloxysuccinic acid, as disclosed in the aforementioned U.S. Pat. No. 3,692,685, and may also comprise sodium or potassium citrates, trisodium- and tripotassium- nitrilotriacetates, sodium carboxymethyl oxymalonate and other appropriate compounds listed in the table at columns 5 and 6 of the aforementioned Barford U.S. Pat. No. 4,199,468.

The weight ratio of these phosphorus-free builders to detergent compound when used in laundering and hand diswashing compositions ranges generally from about 1:20 to about 20:1. When the novel builders are used in mechanical dishwashing compositions, the ratio of builder to detergent compound is from about 3:1 to about 50:1.

The novel builders can be used either as the sole builder or where desired can be used in conjunction with other well-known builders, examples of which include zeolites, oxydisuccinate, tetrasodium and tetrapotassium pyrophosphate, pentasodium and pentapotassium tropolyphosphate, trisodium and tripotassium nitrilotriacetate, polyacrylates, starch or cellulose derived polycarboxylates, and the like, as well as various carbonates. When a combination of builders is used, the ratio of the combined weights of the builders to detergent compound is from about 6:1 to about 50:1.

The chemical compositions of acceptable chlorine-releasing bleaching agents are also well-known, and have been referred to above. The chlorinated isocyanurates are frequently used in this regard. These substances tend to release chlorine when subjected to the action of water, and it is for that reason that, in the past, they had been thought to be contra-indicated when hydrated materials such as CMOS as well as certain active detergent compositions were included in the detergent composition, since the water component of the CMOS or active detergent acted on the chlorine-releasing bleaching agents while the detergent composition was in a standby conditon, thereby causing premature release of the chlorine content and thus rendering an insufficient amount of chlorine available at the time that the detergent is used by mixing it with water in the dishwasher.

The specific compositions for the other types of constituents used in a detergent of the type here specifically under discussion are all well-known, and since they form no special part of the present invention, they will not be further specifically discussed here, it being understood that the choice of types of additional constituents and the particular compositions appropriate to each selected type of constituent are well-known to those skilled in the art.

In accordance with the present invention the constituent or constituents that tend to interact with the chlorine-releasing bleaching agent and cause premature release of the chlorine content thereof, first mixed with certain other constituents in the preferred mode, are formed into granules of appropriate size. That is done by compacting the constituent or mixture and then breaking up the compacted mass into granules of apropriate size. It is believed that the reason that this procedure is effective in minimizing the premature release of the chlorine carried by the bleaching agent is because those constituents which attack the bleaching agent are, in effect, semi-encapsulated in the thus-produced granules, with only a very minor proportion of the attacking constituents being exposed at the surface of the granules; it appears that only the exposed portions can react with the bleaching agent to bring about chlorine release.

As has been indicated, it is preferred that the granules be formed not only of those premature release constituents but also of certain other constituents, in part because the presence of those other constituents in the granule tends to further minimize the exposure of the premature release constituents at the surface of the granule and in part because the addition of these other constituents tends to facilitate granule formation.

A typical non-phosphate built dishwasher detergent may have the following composition:

| Name | % as is |
|---|---|
| CMOS (75% active; 22% water) (builder) | 32.00 |
| Sodium sulfate (filler) | 10.538 |
| Sodium polyacrylate (deposition inhibitor) sold by Colloids Inc. and believed to have a molecular weight in the 500–4000 range) | 3.00 |
| Liquid active detergent (polyoxyethylene compounds sold by Wyandotte Chemicals under the trade-name Pluronic L61 and L62D) | 4.4 |
| Defoamer* | 0.1 |
| Corrosion inhibitor (sodium silicate sold by Philadelphia Quartz under the trade-name Britesil H-24; 18% water) | 13.70 |
| Sodium carbonate (inorganic non-phosphate builder) | 35.00 |
| Perfume | 0.10 |
| Sodium dichloroisocyanurate dihydrate (bleaching agent) | 1.16 |
| Colorants | 0.002 |

*A typical defoamer is monostearyl acid phosphate as described by Schmolka et al, J. Am Oil Chem. Soc. 45 pp 563–566 (1968), incorporated herein by reference. The phosphorus content basis total detergent compostition which is contributed by this level of defoamer is minimal being about 0.01%.

The first four substances (CMOS, filler, deposition inhibitor and active detergent) are mixed together, usually by spraying the active detergent onto the other three substances or by spraying only the CMOS and then adding particles of the filler and deposition inhibitor. That mixture is then passed between the compressing rollers of an appropriate machine such as the one previously referred to as sold under the trademark "Chilsonator". While the compaction pressure exerted by the rolls between which the mixture is passed will vary widely depending upon the particular mixture involved, for the composition here disclosed compaction pressures between 5600 and 8500 pounds of force per inch of roll face are preferred, but lower or higher compaction pressures may be employed.

The compressed mixture leaves the compaction rolls in the form of a self-sustaining solid sheet. That sheet is then broken up into granules, preferably in the particle size range through 14 mesh/retained on 25 mesh, this being the granule size best suited, in conjunction with the other constituents, to produce a properly free-flowing detergent.

Thereafter the granules are mixed with the other constituents, thereby to constitute the final detergent composition.

The following table shows the effect of the compaction and granulation procedure on chlorine loss of the detergent composition during storage. The column headed "RT" indicates room temperature, and the column headed "95/50" represents a temperature of 95° F. at 50% relative humidity.

| | % Available Chlorine Loss After | | | | | |
|---|---|---|---|---|---|---|
| | 2 weeks | | 1 month | | 2 months | |
| | RT | 95/50 | RT | 95/50 | RT | 95/50 |
| Normal powder product | nil | 7.9 | 3.2 | 34.9 | 23.8 | 68.3 |
| Product including compacted granules | nil | nil | nil | nil | 2.8 | 14/1 |

Soda ash, i.e. sodium carbonate, may be utilized as a filler as well as builder and, accordingly, can be used to replace sodium sulfate. It has the advantage over sodium sulfate of a greater ability to absorb active detergent, thereby to improve the flowing characteristics of the composition. Where the builder is CMOS the additional absortivity of soda ash is not particularly needed because the CMOS itself satisfactorily absorbs the active detergent, but if sodium citrate is used as the builder instead of CMOS, then soda ash might well be substituted for sodium sulfate because of the lesser ability of sodium citrate to absorb high levels of surfactant.

Another detergent composition utilizing CMOS as a builder but utilizing a different active detergent (a nonionic surfactant believed to be an alkyl polyoxyethylene polyoxypropylene glycol sold by Olin Chemicals under the tradename Poly-Tergent SLF-18) showed similar improved chlorine-retention and free flow characteristics when the compaction and granulation technique here disclosed was used. In some instances the CMOS was compacted and granulated by itself, and in other instances it was mixed with sodium sulfate filler and sodium carbonate builder before compaction and granulation. Even though in these instances the active detergent, which itself had a greater adverse effect on chlorine stability than did the active material (Pluronic L61 and L62D plus monostearyl acid phosphate) used in the specific preceding example, was added to the composition after the CMOS was granulated, significant chlorine retention improvements of 2.8% loss versus 20% loss at room temperature and 14.1% loss versus 59% loss at 95° F. and 50% relative humidity were observed after a two month period.

Another potential non-phosphorus dishwasher detergent builder is sodium citrate dihydrate. It too, because of its hydrate condition, tends to cause premature chlorine release from bleaching agents with which it may come into contact. Compaction and granulation as above described is also effective when sodium citrate dihydrate builder is used in place of all or part of the CMOS builder, except that higher compaction forces, between 10,000 and 12,000 pounds of force per inch of roll face, are preferred when this builder is employed.

In addition to greatly minimizing chlorine loss, the practice of the present invention produces a granular, free-flowing finished product, something that was not achieved, so far as is known, in prior art detergent compositions utilizing CMOS or sodium citrate as a builder. With the compaction and granulation procedure here disclosed, dynamic flow rates for the complete formula reach the very acceptable value of 128, whereas the dynamic flow rate for products based on CMOS not subjected to the compaction and granulation procedure here disclosed is near zero, and products based on sodium citrate have hynamic flow rates of 90–100. The generally accepted minimum dynamic flow rate is about 110.

Dynamic flow rate is measured as follows: A glass cylinder 3.1 to 3.8 centimeters inside diameter and 60 centimeters long, open at both ends, is inserted into a brass cone of outlet diameter 2.2 centimeters and with a cone angle of 30°. Two marks are made on the cylinder wall 25 centimeters apart, with the lower point 15 centimeters above the bottom of the cone. The outlet orifice of the brass cone is covered, and the material to be tested is poured into the cylinder until the level in the cylinder is about 10 centimeters above the upper mark. The cone outlet is then opened and the time required for the level of the material to fall between the two marks on the cylinder is measured. The volume of the cylinder between those two marks being known, the dynamic flow rate can be computed in terms of cubic centimeters of material per second.

The achievement of this free-flowing granular characteristic is very important commercially, since consumers have come to accept detergents having that characteristic and are loath to purchase detergents which do not have that characteristic, whatever the effective detergent value of such compositions may be.

It is, of course, old, in the detergent field and elsewhere to compact a material and form therefrom granules of desired size. Stokes U.S. Pat. No. 4,127,496 of Nov. 28, 1978, entitled 37 Non-Phosphate Automatic Dishwasher Detergent" discloses that in connection with detergents. But so far as is known, no one previously has taught the compaction and granulation of a selected portion of a composition containing a chlorine-releasing agent and a premature release agent in order to prevent premature chlorine release. The simple use of compaction techniques rather than encapsulation to achieve this result of preventing premature chlorine release is highly unexpected. It may be noted in this regard that in the Stokes Patent, mention is made only of free flow and no mention is made of preventing premature chlorine release. Indeed, since Stokes compacts bleaching agent and substances tending to cause premature chlorine release, his teaching would appear to result in greater premature chlorine release because intimate contact between the bleaching agent and the premature release agent is ensured.

From the above it will be apparent that through the use of a comparatively gross and non-critical material-manipulation step capable of being performed efficiently by commercially existing machinery in a fashion very amenable to mass production, and without requiring the use of any additional materials over and above those used in any event in the detergent composition, a detergent containing chlorine-releasing bleaching agent is produced in which chlorine retention on a stand-by basis is greatly increased, thereby markedly increasing the effectiveness of the detergent when used, and, particularly in the case of non-phosphate-containing detergents, a particulate free-flowing detergent results, something that has heretofore eluded the art. These desirable effects are attained at minimal cost.

While but a limited number of embodiments of the present invention have been here specifically disclosed, it will be apparent that many variations will be made therein all within the scope of the invention as defined in the following claims.

We claim:

1. A method of improving chlorine retention of a particulate detergent composition including a chlorine-releasing bleaching agent and one or more other components which, if the chlorine releasing bleaching agent is exposed thereto, will tend to cause premature chlorine release, which consists essentially of compacting and then forming granules of said other component in the substantial absence of said chlorine-releasing bleaching agent and then mixing said granules with said chlorine-releasing bleaching agent.

2. The method of claim 1, in which said granules contain no more than a minimal amount of phosphorus.

3. The method of claim 1, in which said other component comprises a carboxymethyloxysuccinate.

4. The method of claim 1, in which said other component comprises a citrate.

5. The method of claim 1, in which said granules are formed of a mixture with said other components at least one but not all members of which have said chlorine-releasing effect.

6. The method of claim 1, in which said granules of said chlorine-releasing bleaching agent are mixed with non-premature release components selected from the group consisting of builders, soil suspending agents, hydrotropes, corrosion inhibitors, dyes, perfumes, fillers, enzymes, suds depressants, anti-tarnishing agents, cationic detergents, water softeners, buffers and mixtures thereof.

7. The method of claim 1, in which said granules comprise detergent compound and builder.

8. The method of claim 2 in which said granules additionally comprise filler and deposition inhibitor.

9. The method of producing a particulate detergent composition having improved chlorine retention characteristics, which consists essentially of:

(a) mixing premature release constituents including detergent, builder, filler and other components in the substantial absence of chlorine-releasing bleaching agent;

(b) then compacting the mixture formed in step (a) and forming granules thereof; and (c) thereafter mixing said granules with one or more additional components including a chlorine-releasing bleaching agent.

10. The method of claim 9, wherein said composition is free flowing.

11. The method of claim 9, wherein said composition has a dynamic flow rate of about 90–130 cc of material per second.

12. The method of claim 9, wherein said composition has bulk density higher than about 0.7 grams per cc.

13. The method of claim 9, wherein the particle size of said granules range through 14 mesh retained on 25 mesh.

14. The method of claim 9, wherein the pressure used for said compacting is between 5600 and 12,000 pounds per inch of roll face.

15. The method of claim 9, wherein said granules are formed of a mixture with said other components at least one but not all members of which have said chlorine-releasing effect.

16. The method of claim 9, wherein said other component is selected from the group consisting of soil suspending agents, hydrotropes, corrosion inhibitors, dyes, perfumes, enzymes, suds depressants, anti-tarnishing agent, water softeners, buffers and mixtures thereof.

17. A particulate detergent composition having improved chlorine retention characteristics consisting essentially of a mixture of a chlorine-releasing bleaching agent and granules prepared by compaction of an admixture comprising premature release constituents including detergent, builder, filler and other components in the substantial absence of chlorine-releasing bleaching agent.

18. The composition of claim 17, in which said granules contain no more than a minimal amount of phosphorus.

19. The composition of claim 17, in which said granule constituents comprise a carboxymethyloxysuccinate.

20. The composition of claim 17, in which said granule constituents comprise a citrate.

21. The composition of claim 17 wherein said composition is free flowing.

22. The composition of claim 17 wherein said composition has a dynamic flow rate of about 90–130 cc of material per second.

23. The composition of claim 17 wherein said composition has bulk density higher than about 0.7 grams per cc.

24. The composition of claim 17 wherein the particle size of said granules range through 14 mesh retained on 25 mesh.

25. The composition of claim 17 wherein the pressure used for said compaction is between 5600 and 12,000 pounds per inch of roll face.

26. The composition of claim 17 wherein said granules are formed of a mixture with said other components at least one but not all members of which have said chlorine-releasing effect.

27. The composition of claim 17 wherein said other component is selected from the group consisting of soil suspending agents, hydrotropes, corrosion inhibitors, dyes, perfumes, enzymes, suds depressants, anti-tranishing agents, water softeners, buffers and mixtures thereof.

* * * * *

UNITED STATES PATENT AND TRADEMARK OFFICE

CERTIFICATE OF CORRECTION

PATENT NO. : 4,309,299

DATED : January 5, 1982

INVENTOR(S) : Rapisarda et al

It is certified that error appears in the above—identified patent and that said Letters Patent is hereby corrected as shown below:

Column 7, line 30: "14/1" should be -- 14.1 --.

Column 8, line 18: "hynamic" should be -- dynamic --.

Column 8, line 46: "37 Non-Phosphate" should be -- "Non-Phosphate --.

Claim 9: "The method" should be -- A method --.

Claim 16: "anti tarnishing agent" should be -- anti-tarnishing agents --.

Signed and Sealed this

*Sixteenth* Day of *August 1983*

[SEAL]

*Attest:*

GERALD J. MOSSINGHOFF

*Attesting Officer*

*Commissioner of Patents and Trademarks*